US012757971B2

(12) United States Patent
Di Palma

(10) Patent No.: US 12,757,971 B2
(45) Date of Patent: Oct. 13, 2026

(54) FOOTWEAR IN ASSEMBLABLE KIT AND ASSEMBLY METHODS

(71) Applicant: Massimo Di Palma, Frattamaggione (IT)

(72) Inventor: Massimo Di Palma, Frattamaggione (IT)

( * ) Notice: Subject to any disclaimer, the term of this patent is extended or adjusted under 35 U.S.C. 154(b) by 0 days.

(21) Appl. No.: 19/114,788

(22) PCT Filed: May 30, 2023

(86) PCT No.: PCT/IT2023/050138
§ 371 (c)(1),
(2) Date: Mar. 24, 2025

(87) PCT Pub. No.: WO2024/069658
PCT Pub. Date: Apr. 4, 2024

(65) Prior Publication Data

US 2025/0386905 A1 Dec. 25, 2025

(30) Foreign Application Priority Data

Sep. 29, 2022 (IT) ..... 202022000003930

(51) Int. Cl.
*A43B 3/24* (2006.01)

(52) U.S. Cl.
CPC ..... *A43B 3/246* (2013.01); *A43B 3/244* (2013.01)

(58) Field of Classification Search
CPC ..... A43B 3/246; A43B 3/242; A43B 3/244; A43B 13/36
USPC ..... 36/100, 101, 15
See application file for complete search history.

(56) References Cited

U.S. PATENT DOCUMENTS

| | | | | |
|---|---|---|---|---|
| 5,533,280 | A * | 7/1996 | Halliday | A43B 3/24 36/15 |
| 6,389,712 | B1 * | 5/2002 | Schelling | A43B 13/122 36/31 |
| 7,406,781 | B2 * | 8/2008 | Scholz | A43B 3/246 36/134 |
| 7,730,637 | B2 * | 6/2010 | Scholz | A43B 3/246 36/134 |
| 8,567,096 | B2 * | 10/2013 | Scholz | A43C 15/161 36/134 |
| 9,486,036 | B1 * | 11/2016 | Douglas | A43B 23/0245 |
| 10,959,490 | B1 | 3/2021 | Gomez | |
| 2005/0198868 | A1 * | 9/2005 | Scholz | A43B 3/246 36/134 |
| 2010/0212192 | A1 * | 8/2010 | Scholz | A43B 5/02 36/134 |
| 2017/0303627 | A1 | 10/2017 | Weidl et al. | |

FOREIGN PATENT DOCUMENTS

| | | | |
|---|---|---|---|
| EP | 0723744 | A2 | 7/1996 |
| WO | WO 2011/140584 | A1 | 11/2011 |
| WO | WO 2013/147459 | A1 | 10/2013 |

* cited by examiner

*Primary Examiner* — Ted Kavanaugh
(74) *Attorney, Agent, or Firm* — Hartmans Law Corporation; Joel Fogelson

(57) ABSTRACT

This invention relates to a kit containing a series of assemblable pieces/modules that allows the easy and fast assembly and disassembly of footwear without the use of machinery, glues or particular manual dexterity.

2 Claims, 4 Drawing Sheets

FOOTWEAR IN ASSEMBLABLE KIT AND ASSEMBLY METHODS

This invention relates to a kit containing a series of assemblable pieces/modules that allows the easy and fast assembly and disassembly of footwear without the use of machinery, glues or particular manual dexterity.

As is well-known, the shoe is an accessory of which covers and protects the foot and clothing, allows the wearer to walk more easily on any surface. It is usually made of cloth, leather or various synthetic materials and consists of a more or less extensive upper part, called the upper, which covers the back of the foot up to the height of the malleolus and a lower part that rests on the ground, the sole. The upper represents the upper, outer part of the shoe. It is composed of several pieces sewn together, it can be made of different materials: leather, canvas, in gym shoes it is often synthetic. It can also be made with various materials and colours.

The upper, in turn, is divided into several parts: the leg is the back of the shoe, where the foot is inserted, while the front of the structure is called a mask.

In classic shoes and Monk Straps you can find a decorative front section: the toe cap. While in the moccasin there is often a "tray".

The upper is usually joined to the sole by stitching or gluing. The lining is the inner lining of the shoes. It is under the upper, invisible. Then there is the insole or as indicated in technical insole footwear jargon, the underfoot which is a fundamental component of footwear and which may or may not be removable.

Finally, the sole represents the part in contact with the ground. In good shoes, it is often in leather, to minimise the risk of wear and tear. A vulcanised rubber coating, often with specific grooves or shapes makes the shoe non-slip.

In shoes and boots, the sole is connected to the upper by gluing or hand-stitching, for the most expensive shoes.

The soles are tied to the uppers with various sewing and gluing techniques depending on the shoe model. The most common techniques are: Glueing (for rubber soles), Goodyear Sewing, welt processing techniques, Norwegian hand shoe stitching, Sewing with tubular and bag techniques, blake stitching, quick blake or mec val.

In addition to skills and craftsmanship, numerous and expensive machines are often used for the assembly of footwear such as the fleshing-machine, the splitting machine and sewing machines, heel-nailers and a press to fix to fix the soles. None of these machines is able to work without an operator guiding and controlling them.

It can be said that the machines are an aid to the work of the operator. They help operators to be faster and therefore more productive, to increase the precision of the processing and therefore the repeatability of the same but the knowledge and manual skill of those who use the machines is still essential.

Only a few operations, especially in production, can be fully automated as in the case of grinding the bottom of the mounted upper and spreading the glue on the bottom of the upper and on the sole.

A major drawback encountered in footwear made in series of the type known as state-of-the-art is therefore the impossibility of choosing an upper model based on the morphology of the foot, and of associating it with a sole substantially identified based on the length of the foot.

Another drawback left unresolved by well-known footwear concerns techniques causing wear and tear of the various components. In particular, the wear of the sole, heel and welt is generally not proportional to the wear of the upper, so the user is often forced to not use a pair of shoes with the upper intact nut but where the sole is worn irreparably. Soles and heels are more subject to wear than other parts of the shoe and this leads to having repairs carried out by a specialised craftsman who, for example, must manually replace the heel or carry out renewals of the sole by applying other layers of material, for example a layer of rubber not being able to easily detach from the said worn parts. The intervention of the craftsmen is costly as well as time-consuming.

So glued, stitched or nailed parts of the footwear can be particularly difficult to detach, repair or replace.

A further drawback of currently well-known and market produced footwear is that they are poorly recyclable since they are assembled using glues and solvents.

To overcome these critical issues, over time, footwear has been designed with a particular construction structure to simplify the assembly of the main components such as the upper, insole and sole through the construction of load-bearing uppers detachable from the sole and replaceable thanks to the use of zips or various systems for hooking and unhooking the sole from the upper. Many of these systems have been the subject of patent rights and among them the patent NA2012A000045 describes a shoe that makes summer sandals modular, equipped with a plurality of interchangeable and extractable parts. In practice it is a shoe equipped with a base sole, a removable footbed and various types of bands and replaceable strings that allow you to transform the footwear into a sandal, flip-flop or slipper and this would allow you to change colours, shades and shapes at any time, creating different styles of footwear. The footbed is characterised by through slots for the insertion and locking of strings or bands while the removable footbed is coupled to the sole through the use of male-female velcro. The strength of the various types of footwear made thus is therefore strongly influenced by the quality of seal of the male-female velcro that is continuously attached and detached over time and makes the joints of the various components less firm with the risk of making the sandals themselves little wearable as footwear.

The BE1017907A6 patent provides for the creation of transformable footwear allowing only the various uppers to be changed on a universal sole. The footwear is composed of three fundamental elements: a detachable and interchangeable upper that is fixed to a base sole thanks to the help of an intermediate sole that fits into the upper. The intermediate sole and the universal sole provide, between them, a non-return interlocking system formed by a lift tab present on the intermediate sole that inserts and locks in a profiled cavity made on the base sole. In addition, the entire perimeter of the base sole is characterised by the presence of a variable number of studs suitable for inserting into special holes made on the cap by first passing through numerous notches made on the profile of the intermediate sole. "Prisoners" made on the perimeter of the base sole by passing between the recesses of the intermediate sole and inserting themselves into the perimeter holes of the upper should ensure cohesion and solidity between the upper, the intermediate sole and the base sole. The upper would thus be an easily interchangeable element that would allow you to customise the footwear or vary its external appearance at will. The footwear is made without the help of glues or seams, with an interlocking system between the parts that if subjected to mechanical stress during a run or a simple walk on uneven ground, could easily detach from each other. Also notable is that the quality of the seal of the footwear is guaranteed only by the interlocking of "prisoners" of rubber studs inserted in special niches from which it is possible to easily escape in case of stress or running.

Patent EP1718177B1 describes multi-component footwear that can be removed or replaced at will. You can separate these components and then recombine some or all of these components as desired. The shoe is composed of a flexible cover shaped to wrap at least a portion of the wearer's foot. The shoe is formed by an external lining perforated in a single piece called a cage. Inside the cage is a slipper. Between slipper and the cage there is a sole characterised by lower dowels and upper inlets. The lower dowels are inserted into the lower holes of the cage blocking the sole, while the upper inlets of the sole allow the insertion on the sole of an insole also equipped with dowels. The shoe thus made is simple and easy to make in addition to being particularly comfortable and lightweight, the components are also easily replaceable, but the pieces that come out of the cage are of reduced height to ensure comfort by creating a particularly low shoe sensitive to the conditions of the ground on which you are walking.

Patent CN102429383A describes a footwear system comprising a removable upper and a sole which can be interconnected using a zipper fastened on top of the sole and the bottom of the upper. The sole and upper are thus easily removable and interchangeable, but the locks or tips of the zipper would make the footwear unusable and cause problems in case of rain or wet soil.

U.S. Pat. No. 7,406,781B2 describes a modular shoe formed by an upper, a frame insertable inside the upper and a series of cleats. The upper has, in the preferred embodiment, the shape of a sock hugging the wearer's foot from all sides. Inside the upper is inserted in the frame equipped with threaded projections that can pass through different openings made at the base of the upper. A series of studs can be mounted or dismounted from the frame with the help of screws that, passing through the stud, screw into the threaded projections of the frame and that protrude from the base of the upper. The upper is not glued but held together with the frame when the studs are tightened to the frame inside the upper. This would allow unlimited combinations of various embodiments of the three combined detachable modules (i.e. the upper, the frame and the studs) allowing the manufacturer or the athlete to modify the design and technical properties of the studded shoe over a wide range of possible features, using from time to time shoes made with upper or frames or studs combined each with different characteristics. It is a sports shoe, for prevalent use on football fields designed to have studs and frames of different types depending on the field of play on which they are used.

The patent WO2011080779A1 concerns assemblable modular footwear that is characterised by the interchangeability of its constituent components. This would be possible through the use of components common to normal footwear through coupling and uncoupling means so that the elements constituting the footwear can be stably associated or disassembled with each other. Among the latter, a shaped underfoot frame equipped with mushroom-headed pegs that protrude perpendicularly from its lower face. The said upper insole element is suitable to be inserted in the upper, with the mushroom pegs that protrude from corresponding holes in the lower surface of the upper to then be inserted into particular slots made on an elongatable and dividable intermediate sole in two parts to reinforce the plantar area and the heel area and then lock in raised seats made on the upper facade of the sole that is in contact with the ground. The tightness of the various components should be guaranteed by the proper insertion of the mushroom pegs. But as can easily be intuited, such a solution is not feasible since the incorrect insertion of the mushroom pins inside the slots including as a result of the possible blunting and wear of the mushroom pins, would make the assembly not particularly solid with problems for the tightness of the entire shoe or part of it. In addition, the patent is limited to the assembly only and exclusively of a part of the shoe that moreover would not have any reinforcement to be readily used.

U.S. Pat. No. 7,984,569B2 describes a shoe with removable modular sole components allow the customisation of a shoe with respect to traction, cushioning, support, fit, performance and aesthetic characteristics. It is an almost completely assembled shoe characterised by a single receiving sole equipped with perimeter male-female joints made respectively on the receiving sole and on the detachable sole module so as to be able to interface. In addition to the male-female joints, various embodiments are provided to keep the sole module attached to the receiving sole. Among these, in addition to the male-female joints, there is also a tongue with an eyelet located on the back of the sole module that can trace the heel of the shoe to hook on a peg in the rear area of the shoe to hold the detachable sole module more firmly or use a large threaded central screw with a round head capable of screwing between the removable sole module and the receiving module in order to avoid perpendicular or parallel movements of the sole module with respect to the receiving sole. The upper in this case is not replaceable and the male-female hooks are not very grippy. The best solution of the coupling with a single central screw does not guarantee a possible release of the sole from the peripheral flaps of the shoe.

This invention overcomes the critical issues highlighted heretofore by providing for the creation of footwear that can be easily assembled without the aid of glues, seams, nails or machinery. Items created in this way in case of wear or damage to a single component of the footwear can be easily disassembled, replaced and reassembled. Likewise, the shoe, in all its components, can change its look without the need to purchase a new shoe and can be adapted to any type of need (e.g. replacement of the sole to adapt it to the ground, replacement of the type of leg to grip in different areas of the ankle, replacement of the toe type if greater protection of the fingers is needed, replacement of the sole to increase or lower its height, etc.).

This invention will now be described, by way of illustration, according to a preferred embodiment not to be construed in any limiting way, with particular reference to the figures and the attached drawings, taking into account that all the embodiments used, without prejudice to their functionality, may vary in size, numbers and shape without this limiting the present invention:

Figure 1:
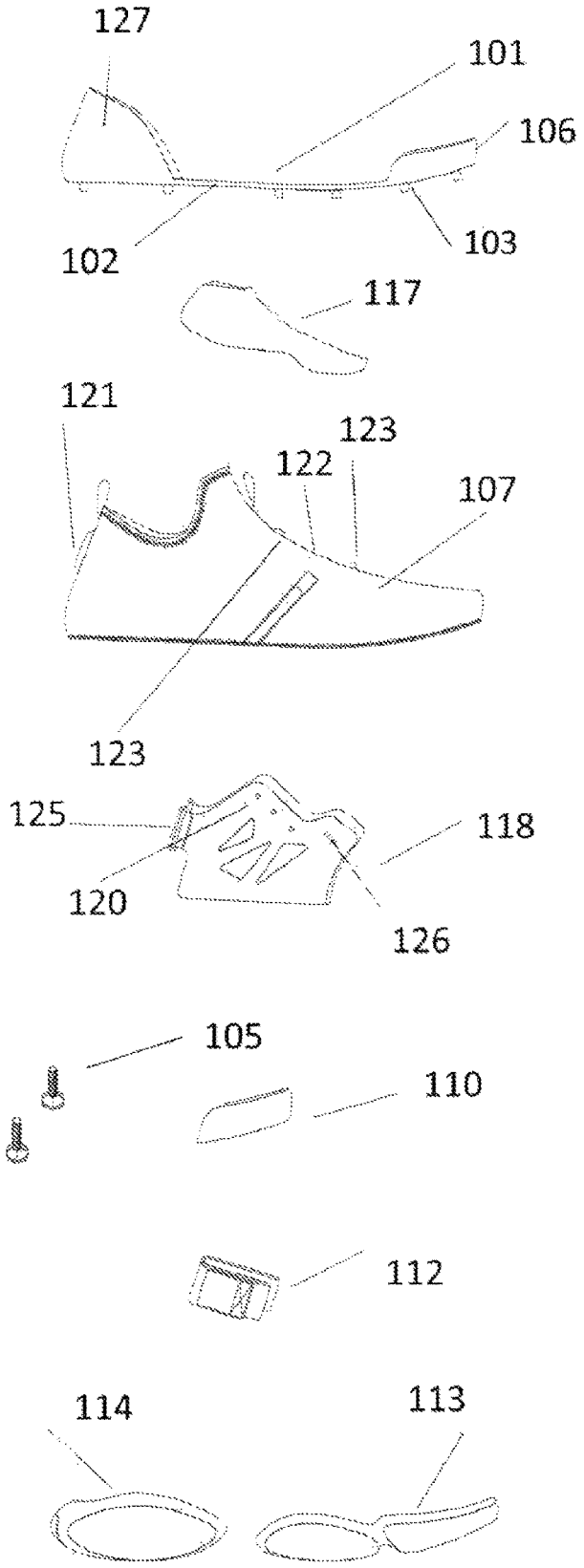
FIG. 1 shows a side view of all the components of the footwear in kit form.
Figure 2:
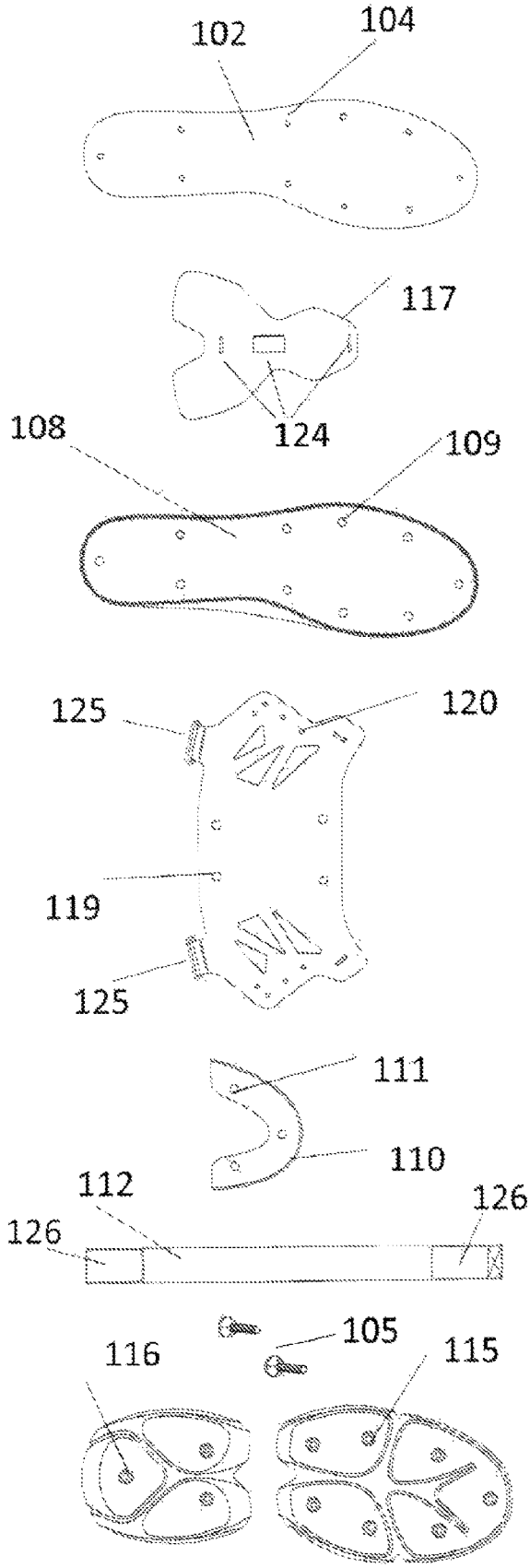
FIG. 2 shows a view from below of all the components of the footwear in kit form.
Figure 3:
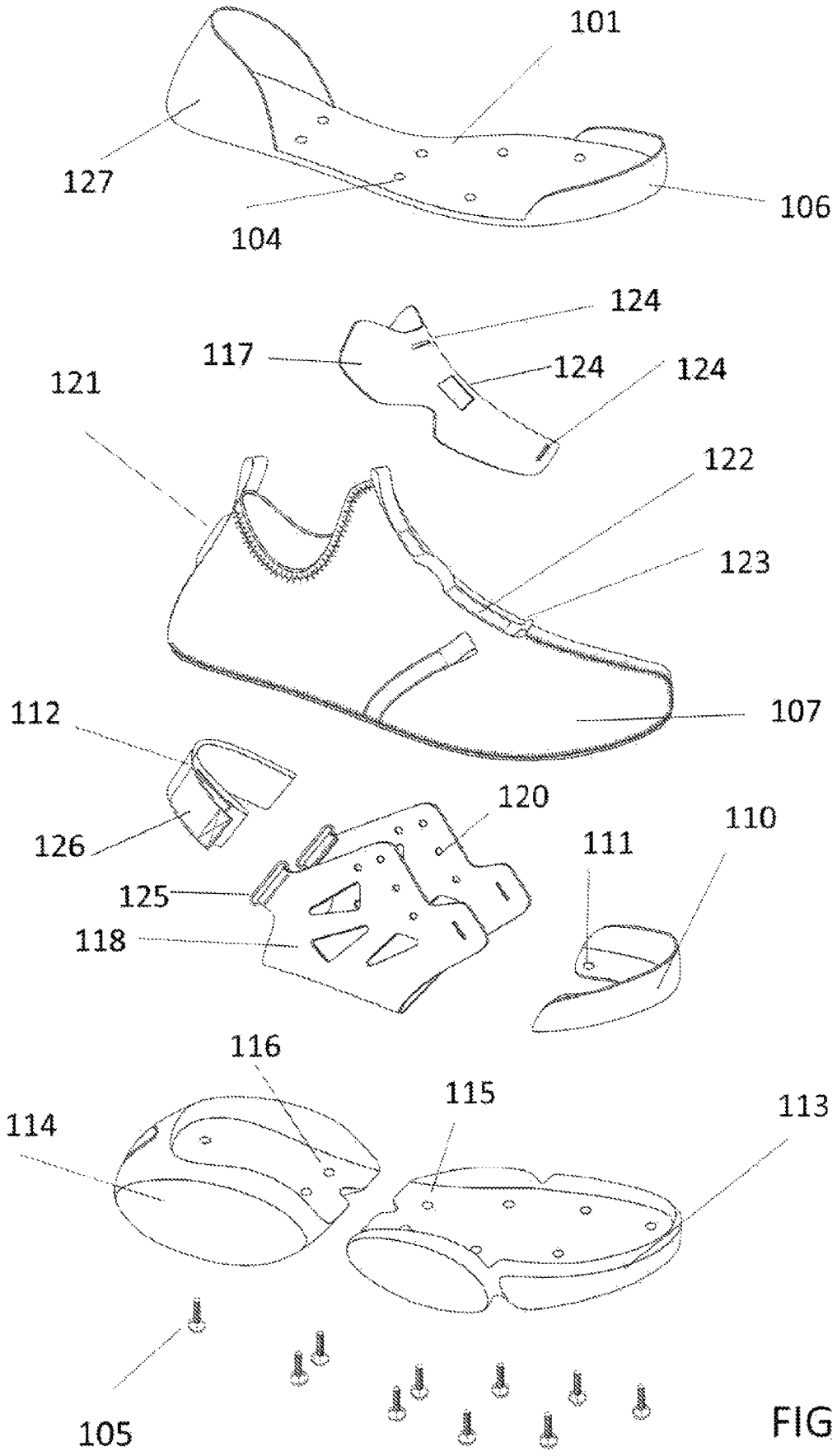
FIG. 3 shows an exploded view of all the components of the footwear in kit form.
Figure 4:
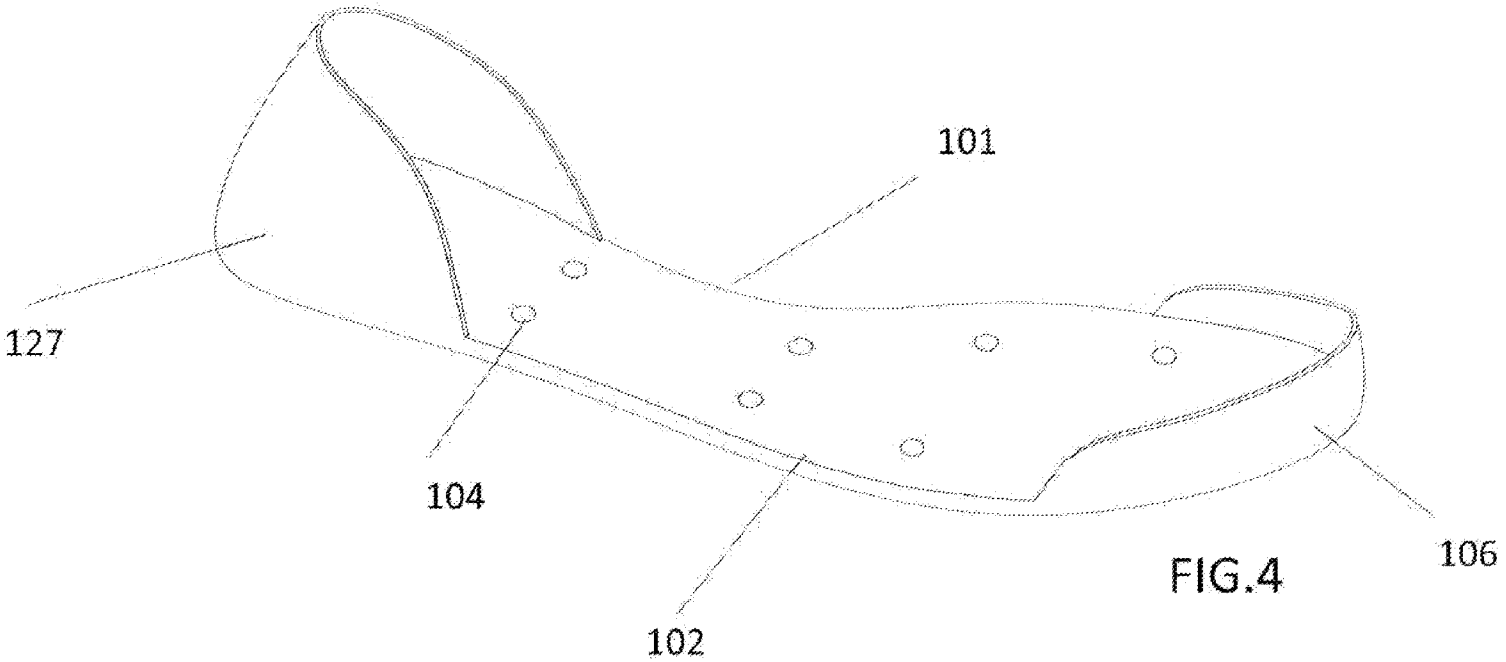
FIG. 4 shows a side view of all the components of the footwear in kit form.
Figure 5:
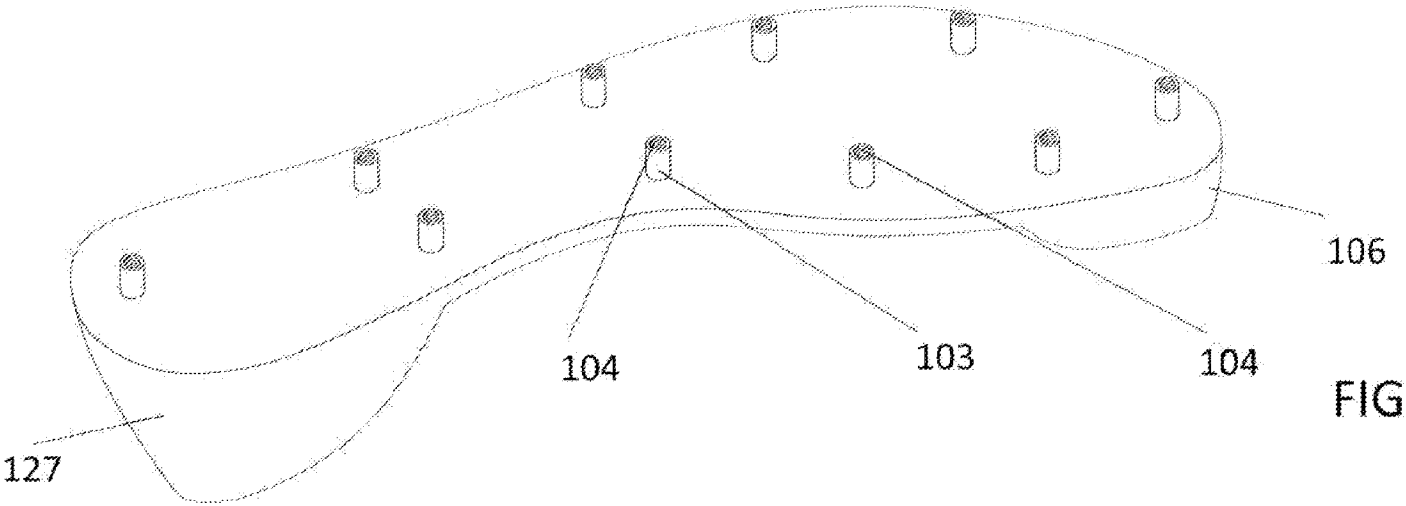
FIG. 5 shows a side view of all the components of the footwear in kit form.
Figure 6:
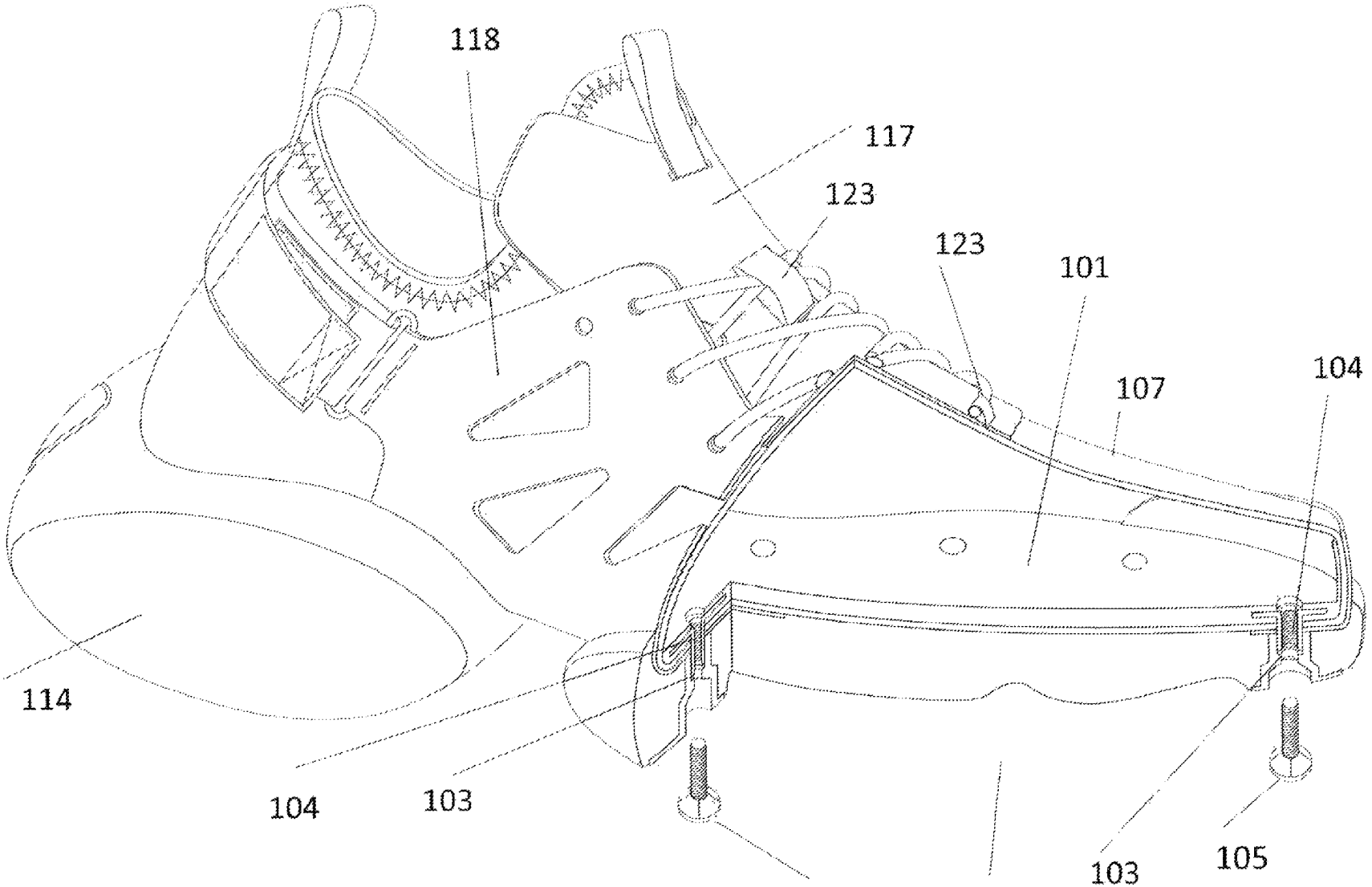
FIG. 6 shows a side view of the footwear in kit form fully assembled with a transparent section.

Referring to the figures, created only for explanatory and descriptive purposes, note that the kit for the creation of the footwear is composed of an endoskeleton 101 characterised by the presence of reinforcement 106 and reinforcement 127 into one with an elastic membrane 102 on which cubes 103 are present, protruding from the lower part of the upper 107, characterised by threaded holes 104 inside which a threaded screw 105 will be inserted during assembly.

The kit is also characterised by an upper 107 which in the upper part is equipped with a strip 122 with at least one loop for the laces 123 and in which the tab 117 is inserted.

The base 108 of the upper is also characterised by the presence of holes 109 that match the cubes 103 present on the elastic membrane 102 and on which they will be inserted during assembly.

In addition, there are three modules: the tip module 110 characterised by the presence of holes 111 that match the cubes 103 present in the front of the elastic membrane 102 and on which they will be fixed during assembly (in this way the tip of the endoskeleton 101 acts as a counterplate to the tip module 110), the heel module 112, equipped with felts 126 that will be fixed on the outer back of the upper 107 and the lacing module 118 characterised by central holes 119 that match the cubes 103 present on the elastic membrane 102, on which they will be fixed during assembly, from the holes 120 through which the laces of the shoes pass and from the housings 125 in which the felts 126 of the heel module 112 are inserted.

The kit has a perforated front sole 113 provided with holes 115 and a rear sole 114 provided with holes 116 that, in both cases, match the cubes 103 present in the front of the elastic membrane 102.

Finally the kit is composed of a tongue 117 characterised by at least one housing 124 in which the slot 123 present on the upper 107 is made to pass.

During assembly, the endoskeleton 101 is inserted into the upper 107 by inserting the cubes 103 present on the endoskeleton 101 into the holes 109 present on the base 108 of the upper 107. In this way the cubes 103 will protrude outwards.

Subsequently, the lacing module 118 must be positioned below the central part of the upper by making the cubes 103 present on the endoskeleton 101, already positioned inside the upper 107, engage in the holes 119.

At this point the holes 115 and 116 of the two perforated soles 113 and 114 will be positioned under the upper 107, making them match the cubes 103 present on the endoskeleton 101, already positioned inside the upper 107.

The heel module 112 will then be inserted into the back of the upper, passing it through the slot 121 and the tab 117 will be positioned on the upper 107, covering it with the lacing module 118, matching the different holes therein and finally the threaded screws 105 will be screwed inside the cubes 103.

At this point the shoe will be perfectly assembled and if you want to change a module/piece it will simply be necessary to unscrew the screws 105 and change the desired piece/module.

The present invention has been described in relation to its functionalities and the assembly method by way of illustration but not limited to such and it is therefore to be understood that variations and/or modifications, including to the shapes, dimensions and measures of the invention, as well as to the arrangement and materials of the components that compose it may be made without compromising the relevant protection.

The invention claimed is:

1. Footwear in assemblable kit, comprising:

a) an endoskeleton composed of a tip, a reinforcement and an elastic membrane on which there is a set of projections, wherein the set of projections protrude from the bottom of the endoskeleton, wherein the set of projections have threaded holes engaged by a corresponding threaded screw;

b) an upper which at a top is equipped with a strip with at least one loop and the first set of holes, wherein the one loop is configured to receive a one shoe lace and the holes are configured to match the set of projections;

c) a tip module having a second set of holes that match the set of projections in a front portion of the elastic membrane;

d) a heel module configured to engage an outer back of the upper e) a lacing module having a set of central holes that match the set of projections of the elastic membrane;

f) a perforated front sole provided with holes and a rear sole provided with holes that, in both cases, match the set of projections in the front portion and a rear portion of the elastic membrane, respectively; and g) a tongue having at least one housing hole, wherein the one shoe lace is configured to pass through the housing hole and at least one loop of the upper.

2. A method of assembly for footwear in an assemblable kit comprising the steps:

an endoskeleton having a set of projections on a bottom of the endoskeleton, wherein the endoskeleton is to be inserted inside an upper by entering at least one of the set of projections inside at least a set of holes on the base of the upper;

a lacing module positioned below a central part of the upper, and a first sole and second sole positioned below the lacing module, wherein the set of projections of the endoskeleton, when positioned inside the upper, engage a second set of holes of the lacing module and at least one hole in the first sole and at least one hole in the second sole;

making the holes of the first and second soles match at least one of the set of projections of the endoskeleton, already positioned in the upper;

inserting a heel module in a back of the upper, by passing it through a slot in the back of the upper and positioning a tongue on the upper;

covering it with the lacing module; and threading a set of threaded screws into a set of threaded holes of the set of projections.

* * * * *